US005527984A

United States Patent [19]

Stultz et al.

[11] Patent Number: 5,527,984

[45] Date of Patent: Jun. 18, 1996

[54] WASTE GAS INCINERATION

[75] Inventors: Jeffrey H. Stultz, Freeport; Danford L. Bice, Lake Jackson, both of Tex.

[73] Assignee: The Dow Chemical Company, Midland, Mich.

[21] Appl. No.: 368,531

[22] Filed: Jan. 4, 1995

Related U.S. Application Data

[63] Continuation of Ser. No. 55,160, Apr. 29, 1993, abandoned.

[51] Int. Cl.[6] ..... B01D 53/44; B01D 53/34

[52] U.S. Cl. ..... 588/205; 588/206; 588/207; 423/245.3; 110/213; 431/5; 431/9

[58] Field of Search ..... 431/5, 8, 9; 588/205, 588/206, 207; 423/245.3; 110/213

[56] References Cited

U.S. PATENT DOCUMENTS

| | | | |
|---|---|---|---|
| 3,830,620 | 8/1974 | Martin | 431/350 |
| 3,868,211 | 2/1975 | Have et al. | 431/10 |
| 3,917,796 | 11/1975 | Ebeling | 423/210 |
| 3,985,494 | 10/1976 | Childree | 431/175 |
| 4,068,874 | 12/1977 | Stary et al. | 431/350 |
| 4,101,632 | 7/1978 | Lamberti et al. | 431/5 |
| 4,154,567 | 5/1979 | Dahmen | 431/5 |
| 4,483,832 | 11/1984 | Schirmer | 423/210 |
| 4,646,660 | 3/1987 | Bjorkman et al. | 110/210 |
| 4,661,056 | 4/1987 | Vickery et al. | 431/5 |
| 4,859,173 | 8/1989 | Davis, Jr. et al. | 431/175 |
| 4,878,440 | 11/1989 | Tratz et al. | 110/233 |
| 4,957,050 | 9/1990 | Ho | 431/9 |
| 4,975,042 | 12/1990 | Schwartz et al. | 431/5 |
| 5,055,278 | 10/1991 | Reidick | 423/235 |
| 5,061,463 | 10/1991 | Vickery | 423/210 |
| 5,076,779 | 12/1991 | Kobayashi | 431/5 |
| 5,080,026 | 1/1992 | Tsunemi et al. | 110/346 |
| 5,131,836 | 7/1992 | Coppin | 431/12 |
| 5,190,672 | 3/1993 | Coenen et al. | 210/770 |
| 5,205,227 | 4/1993 | Khinkis et al. | 110/345 |
| 5,269,263 | 12/1993 | Garcia-Mallol | 431/10 |
| 5,295,816 | 3/1994 | Kobayashi et al. | 431/9 |
| 5,316,469 | 5/1994 | Martin et al. | 431/116 |
| 5,403,181 | 4/1995 | Tanaka et al. | 431/8 |

OTHER PUBLICATIONS

"Afterburner Systems Study," Rolke et al, Shell Development Company, Aug. 1972, distributed by Nat'l Technical Information Service entire document, particularly Chapters 13–15 on pp. 205–238.

"Burners and Burner Aerodynamics," Wendt, 1991. (admitted to be prior art).

*Primary Examiner*—Gary P. Straub
*Assistant Examiner*—Timothy C. Vanoy

[57] ABSTRACT

Methods for the incineration of waste gas containing oxygen are disclosed which, in one aspect, have a combustion chamber with a high intensity, stable burner jet projecting therein and a backmixing zone in which are mixed burner fuel and waste gasses flowing into the chamber via a waste gas flow line. As desired additional fuel, e.g. fuel such as methane added to vitiated air, may be introduced into the chamber. Preferably, the heat content of the supplemental fuel is adjusted to control temperature in the combustion chamber while a stable combustion zone is provided. In one aspect flue gas from the chamber flows to a heat recovery apparatus to recover heat value of the flue gas.

24 Claims, 1 Drawing Sheet

WASTE GAS INCINERATION

This is a continuation of application Ser. No. 08/055,160 filed on Apr. 29, 1993 now abandoned.

BACKGROUND OF THE INVENTION

1. Field of the Invention

This invention relates to the incineration of waste gas and, in one aspect, to systems and methods for incinerating vented waste gas containing oxygen, nitrogen and volatile organic waste.

2. Description of Related Art

The prior art discloses a variety of systems used for incinerating waste gasses. These include: regenerative vent incinerators; large main burner incinerators; and catalytic converters.

In certain large main burner incinerators and multiple burner incinerators enough fuel and air must be provided to the burner to heat contaminated or vitiated waste gas streams so that volatile organic waste therein is destroyed, e.g. at a required temperature of about 1700 degrees Fahrenheit. Such systems require a relatively large amount of fuel and of combustion air, a relatively large volume combustion chamber, and relatively large flue gas cleaning equipment. Regenerative waste gas ("vents") incinerators are relatively expensive; have a relatively low destruction efficiency of waste organic; are mechanically complex; and have a comparatively low turndown (i.e. percent of rated capacity, e.g. 85% to 100%) based on fuel value of waste gases. Catalytic converters are relatively expensive. Catalysts used therein are subject to poisoning rendering them inefficient or ineffective. Low turndown and lack of temperature control of a catalyst bed may present problems such as damage to equipment, low efficiency, corrosion of equipment, and the level of organic destruction may be relatively low.

Some prior art waste gas incinerators employ contaminated air for combustion air in a main burner, resulting in unstable flames if waste gas low in oxygen is being incinerated. If fuel value of the contaminants varies, control and safety problems result such as flameout or flashing back into a vent header. Such a burner is usually being fired in a fuel-starved or fuel-rich condition, creating further stability problems.

There has long been a need for methods and systems for efficiently and effectively incinerating waste gasses. There has long been a need for such methods and systems which can be run for long periods of time in a stable manner. There has long been a need for such methods and systems which do not require large main burners and which provide an acceptable level of destruction of organic wastes. There has long been a need for simple solutions to these problems which can be effected at relatively low cost. There has long been a need for such methods and systems which do not rely on catalysts, particularly catalysts which can be poisoned.

SUMMARY OF THE PRESENT INVENTION

The present invention, in one aspect, discloses a method for incinerating waste gasses to destroy waste organics therein which includes introducing the waste gasses into a combustion chamber having a relatively small burner whose burner jet projects into the chamber, the chamber having a backmixing zone therein; adding supplemental fuel to the oxygen-containing waste gasses and introducing this into the backmixing zone; and burning the waste gasses in the chamber. In one aspect this invention discloses a waste gas incineration system including a combustion chamber; a burner jet disposed therein; a backmixing zone therein; and apparatus for feeding supplemental fuel into the chamber. Waste gas may be fed into the chamber at one or more feed points. Waste gas may be fed into the chamber with the supplemental fuel. The temperature of burning in the combustion chamber is controlled by controlling the amount of supplemental fuel supplied. This can be done based on a direct temperature measurement or on a measurement of output oxygen levels. In one aspect the waste gasses are vitiated nitrogen vents; the supplemental fuel is methane; and it is introduced with vitiated air into the combustion chamber.

In one embodiment such methods and systems employ a high efficiency incinerator for waste gasses, (e.g. vitiated nitrogen waste vents with volatile organic and vitiated air having some oxygen therein), which has a relatively small burner jet operated at near stoichiometric conditions for increased efficiency, good mixing, and efficient combustion. Preferably the waste gas stream is introduced at the flame base of the burner to allow the backmixing flue gasses to provide oxygen for combustion and minimal exposure to the high flame temperature of the burner jet. A sparger feeds auxiliary fuel or relatively high Btu value waste gas as needed for temperature control into the chamber, preferably with the vitiated air. The waste gas feed geometry (i.e. into the burner jet flame base) and the use of adjustable amounts of auxiliary fuel provide stable temperature control and high efficiency destruction of volatile organics, high thermal efficiency, and a minimum of needed auxiliary fuel. Gasses discharged from the chamber are minimal and require a minimum of further quenching and scrubbing. Turndown is relatively high for certain preferred embodiments, e.g. below 20% and preferably 10% or less of rated capacity.

In one embodiment waste gas is introduced adjacent to the jet burner face through a plurality of radially placed nozzles with conventional ceramic discs with holes therethrough to provide uniform gas flow to the incinerator and to reduce radiant heat from the combustion chamber from heating the feed lines and materials therein. In another embodiment gas emitted from a chamber as described above flows to a heat recovery apparatus so that heat value of the gas is not wasted. In one aspect a boiler is used and recovered heat flowing to the boiler produces usable steam.

In one aspect systems according to this invention are horizontally fired; in another aspect systems are vertically fired. Added auxiliary fuel may be gas, vapor, or liquid.

It is, therefore, an object of at least certain preferred embodiments of the present invention to provide:

- New, useful, unique, efficient, non-obvious methods for incinerating oxygen containing waste gas;
- Such methods which employ a combustion chamber with a relatively small burner and an annular backmixing zone;
- Such methods which employ multiple feed lines feeding waste gas, auxiliary fuel or both;
- Such methods which minimize flue gas emitted from the system;
- Such methods which produce a high level of destruction of volatile materials with a minimum of undesirable materials in flue gas emitted from the system; and
- Such methods with which at least 99% of volatile materials are destroyed.

This invention resides not in any particular individual feature, but in combinations of them claimed herein and it is distinguished from the prior art in these combinations with their structures and functions. There has thus been outlined, rather broadly, features of the invention in order that the detailed descriptions of certain embodiments thereof that follow may be better understood, and in order that the present contributions to the arts may be better appreciated. There are, of course, additional features of the invention that will be described hereinafter and which may form the subject matter of the claims appended hereto. Those skilled in the art will appreciate that the conceptions, upon which this disclosure is based, may readily be utilized as a basis for the designing of other structures, methods and systems for carrying out the purposes of the present invention. It is important, therefore, that the claims be regarded as including any legally equivalent constructions insofar that do not depart from the spirit and scope of the present invention.

The present invention recognizes and addresses the previously-mentioned problems and long-felt needs and provides a solution to those problems and a satisfactory meeting of those needs in its various possible embodiments and equivalents thereof. To one of skill in this art who has the benefits of this invention's realizations, teachings and disclosures, other and further objects and advantages will be clear, as well as others inherent therein, from the following description of presently-preferred embodiments, given for the purpose of disclosure, when taken in conjunction with the accompanying drawings. Although these descriptions are detailed to insure adequacy and aid understanding, this is not intended to prejudice that purpose of a patent which is to claim an invention no matter how others may later disguise it by variations in form or additions of further improvements.

DESCRIPTION OF THE DRAWINGS

So that the manner in which the above-recited features, advantages and objects of the invention, as well as others which will become clear, are attained and can be understood in detail, more particular description of the invention briefly summarized above may be had by references to certain embodiments thereof which are illustrated in the appended drawings, which drawings form a part of this specification. It is to be noted, however, that the appended drawings illustrate certain preferred embodiments of the invention and are therefore not to be considered limiting of its scope, for the invention may admit to other equally effective or equivalent embodiments.

DESCRIPTION OF EMBODIMENTS PREFERRED AT THE TIME OF FILING FOR THIS PATENT

Figure 1:
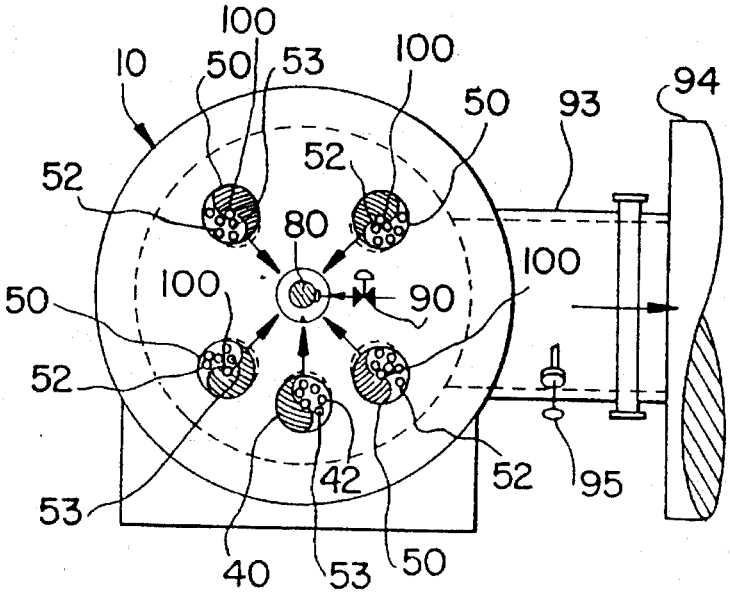
FIG. 1 is a cross-sectional front view of a system according to the present invention along line A—A of FIG. 2.
Figure 2:
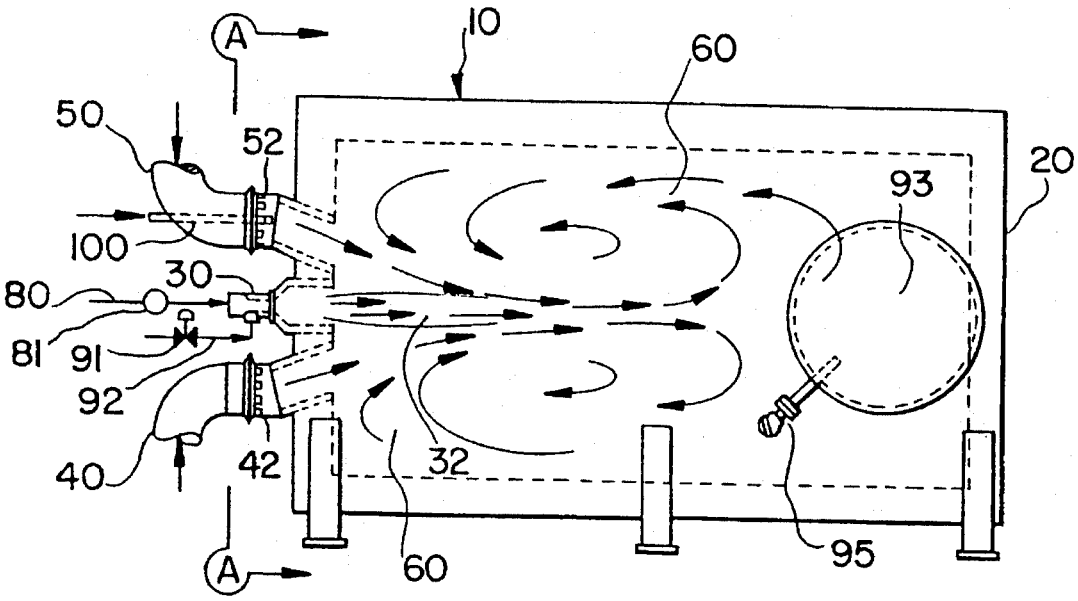
FIG. 2 is a side view in cross-section of the system of FIG. 1 according to the present invention.

Referring now to FIGS. 1 and 2, a high efficiency vent incinerator 10 has a combustion chamber 20 to which is mounted a small jet burner 30. The burner 30 is most preferably mounted in the middle of the chamber 20. A burner jet 32 projects into the chamber 20. A stream of vitiated nitrogen with volatile gasses such as hydrogen sulfide, carbon tetra chloride, ethylene dichloride, or benzene is fed into the chamber 20 through a feed line 40. Vitiated air vents (e.g. oxygen deficient air contaminated with volatile organic material) are fed into the chamber 20 through feed lines 50. Auxiliary fuel such as methane, fuel gas, waste oil (atomized) or hydrogen may be fed through spargets 100 into the vitiated air through the feed lines 50.

Jet burner combustion air flows under pressure through a feed line 80 and fuel gas flows through a feed line 92 through the burner 30 and mixes with materials flowing into a backmixing zone 60 in the chamber 20, wherein mixing is accomplished by the induction of the gasses into the flame jet 32. A valve 91 controls flow in the line 92.

In one embodiment a North American Mfg. Co. flame jet gas burner No. 4545-9 is used as the burner 30. Minimal combustion air is provided to the burner 30 with a surgeless blower 81 through the line 80 such as a Type SBE-182 of Robinson Industries, Inc. rated at 2130 CFM at 24.3" water column static pressure. In one embodiment 2000 SCFM of contaminated nitrogen vents are fed into the line 40 and 20,000 SCFM (maximum) of vitiated air with oxygen, preferably 5% to 20% oxygen by volume (and most preferably 13% to 18% by volume) is fed through the lines 50. Combined nitrogen vents and vitiated air may contain from 0% to 90% of fuel value required for temperature control. The chamber 20 is operated at a temperature most preferably between about 1200 degrees Fahrenheit to about 1800 degrees Fahrenheit, and in one aspect preferably 1650 degrees Fahrenheit, and a destruction and removal efficiency for volatile organics of about 99% or more and most preferably 99.9% is achieved. Temperature control is achieved by adding fuel such as methane, hydrogen, or atomized waste oil into the lines 50 via a sparget or lance 100.

One or more conventional ceramic discs 42 or 52 with plural holes 53 therethrough are used in the lines 40 and 50, respectively, to provide uniform flow of gasses from the lines 40 and 50 and to insulate portions of the lines and materials therein from heat produced in the chamber 20. Gas flows through the holes in the discs. A fuel sparger, nozzle, or lance 100 extends through each of the discs 52.

Flue gas with the products of burning resulting from the combustion of material in the chamber 20 exits through a line 93. In this embodiment heat value of the flue gas is recovered in a boiler 94 (partially shown) which produces usable-steam at 235 psig.

For one embodiment of a system according to this invention a turndown calculation is as follows:

Minimum fuel value of vents into line 40 is zero.

Maximum fuel value of vents into line 40:

Example:

For 22000 SCFM air & nitrogen at 80 degrees F. Vent flow and 5,000,000 Btu/hour net heating value methane firing through line 90:

Rate from main burner at stoichiometric air firing=4245 lbs/hour flue gas from burner ("stoichiometric" means air containing that amount of oxygen necessary to convert all combustibles to their combustion products).

Input vent rate, lines 40 and 50,=101,003 lbs/hour

Total flue gas out line 92 at 1800 degrees F.=107,057 lbs/hour

Change in enthalpy of flue gas at 15% water, 80 degrees F. to 1600 degrees F.=48,700,000 Btu/hour Main burner fuel (methane) contribution=5,500,000 Btu/hour gross Design maximum turndown=0 to 90% of total firing as organic waste, calculated as methane in line 100.

By comparison a vent incinerator providing heat at the main burners only and firing at stoichiometric air (although 15% above stoic. air is typical) would require 70,491,000

Btu/hour firing at the main burner and produce a vent rate of 154,936 lbs/hour flue gas in line 93. In this example, a system according to this invention uses only approximately 69% of the fuel used in the large main burner system and generates only about 69% of the flue gas. In other words a prior art system firing at stoichiometric air to fuel would use 44.8% more fuel and produce 44.7% more flue gas than the embodiment described above. If the main burner is fired at sub-stoichiometric air, carbon monoxide is produced with free carbon and combustion efficiency is reduced unless the temperature in the combustion chamber is elevated, e.g. by about 300 degrees Fahrenheit.

The vent flows in lines 40 and 50 can vary from zero flow to maximum flow without loss of efficiency of destruction of volatile organic material. Fuel flow to the burner can be reduced and more combustion air added in line 80 for temperature maintenance in the chamber 20 at very low or no waste gas flow through lines 40 and 50.

It is preferred that residence time of gasses in the combustion chamber range between 0.25 and 5.0 seconds, with 0.75 seconds most preferred and that burner size range between five and fifty percent, and most preferably twenty percent of heat duty.

With certain embodiments of this invention oxygen in the waste gas burns the fuels (as contrasted with systems in which additional combustion air with fuel must be used to provide the heat to destroy waste organics) (waste organics are e.g. methane, benzene, ethane, hydrogen sulfide, mercaptans). This results in a flue gas vented from the system which is low in oxygen (e.g. preferably 7% or lower, most preferably 5% or lower). Such a system also requires relatively low combustion zone temperatures (e.g. 1650 degrees F.). Due to flue gas backmixing with nitrogen and vitiated air, the system's product is low in nitrous oxides level (e.g. less than 150 parts per million) and high in thermal efficiency (e.g.uses 69% of the total fuel value to achieve the same temperature and all combustion occurs in the presence of at least stoichiometric oxygen). It is preferred that the waste gasses in line 50 contain about 5% to about 20% oxygen and most preferably 3% to 18% oxygen; but systems and methods according to this invention can be used with contaminated oxygen vents having up to 99% oxygen by volume.

In preferred embodiments due to the relatively high velocity of flow from the burner jet compared to the velocity of waste gas flow into the chamber, waste gas and recycled flue gas are inducted into the jet's flame. It is preferred that the flow from the burner and supplemented fuel induce enough flow to recycle flow of flue and waste gas through the combustion zone. Combustion temperature near the point of burner jet flow introduction into the combustion chamber is relatively high (e.g. 3200 degrees F.) compared to the combustion temperature further out in the chamber (e.g. 1200 to 1800 degrees F.). (Preferably, the combustion temperature is no more than about 60% of the relative high temperature.) The high velocity burner jet flow propels and mixes the waste gasses in the area of lower combustion temperature. A lower combustion temperature is preferred because less fuel is required, better turndown is achieved, and less thermal and chemical nitrogen oxides are formed. The waste gasses, introduced into the relatively low temperature zone quench (cool) the hot combustion area near the point of burner jet flow introduction. A temperature sensor 95 in the line 93 indicates temperature of material in the line 93 and in the combustion chamber 20.

A computer simulation of the example described indicates backmixing occurs resulting in relatively uniform temperatures in the combustion zone. Contaminated oxygen vents and pure oxygen may be incinerated effectively with embodiments of this invention.

Filed on even date herewith are the following applications, co-owned with this application, whose subject matter is hereby disclosed herein and which may be employed with the present invention in a material treatment system (invention titles followed by applicant(s) name):

Sludge Digestion; J. Stultz, D. Bice

Sludge Ammonia Removal; J. Stultz, D. Bice

Sludge Deodorization; J. Stultz, D. Bice

Tank Foundation; J. Stultz;

Pipe To Concrete Transition; J. Stultz

Slab Joint Liquid Stop; J. Stultz

Sludge Clarifier Bottom; J. Stultz, H. Rabren

Sludge Clarifier Roof; J. Stultz

Hopper Liner; J. Stultz

In conclusion, therefore, it is seen that the present invention and the embodiments disclosed herein and those covered by the appended claims are well adapted to carry out the objectives and obtain the ends set forth. Certain changes can be made in the described and in the claimed subject matter without departing from the spirit and the scope of this invention. It is realized that changes are possible within the scope of this invention and it is further intended that each element or step recited in any of the following claims is to be understood as referring to all equivalent elements or steps. The following claims are intended to cover the invention as broadly as legally possible in whatever form its principles may be utilized.

What is claimed is:

1. A method for incinerating air contaminated with volatile organic material, the method comprising providing contaminated air containing from 5 to 18 volume percent oxygen and organic volatile compounds, said air being incapable of providing stable combustion;

introducing said air into a combustion chamber having a burner connected thereto from which a burner jet projects into the combustion chamber, the combustion chamber having a backmixing zone therein, introducing fuel gas and combustion air to the burner, the combustion air containing an oxygen level that is about stoichiometric for complete combustion of the fuel gas, the fuel gas and air being introduced in quantities sufficient to sustain the burner jet, introducing auxiliary fuel into the combustion chamber, burning said air, combustion air, fuel gas and auxiliary fuel in the combustion chamber to destroy volatile organic material, oxygen for destroying volatile organic material being provided by oxygen present in said air without adding combustion air other than that needed to sustain the burner jet, controlling flow of auxiliary fuel into the combustion chamber to control temperature in the combustion chamber, and removing from the combustion chamber products of the burning therein.

2. The method of claim 1 wherein the burner jet induces a flow of contaminated air and auxiliary fuel into the backmixing zone.

3. The method of claim 1 including controlling the flow of auxiliary fuel so that the combustion temperature is between 1200 and 1800 degrees Fahrenheit.

4. The method of claim 3 wherein the combustion temperature is 1650 degrees Fahrenheit.

5. The method of claim 4 wherein the residence time is about 0.75 seconds.

6. The method of claim 5 comprising also venting a flue gas from the combustion chamber, the flue gas containing the products of burning therein, the flue gas having an oxygen content of no more than 7% by volume.

7. The method of claim 6 wherein the oxygen content of the flue gas is no more than 5% by volume.

8. The method of claim 6 wherein the flue gas has a nitrous oxide level of no more than 150 parts per million.

9. The method of claim 6 comprising also recovering heat from the flue gas.

10. The method of claim 9 including using the recovered heat in a boiler to produce steam.

11. The method of claim 1 including maintaining residence time of the contaminated air in the combustion chamber between 0.25 and 5.0 seconds.

12. The method of claim 1 comprising also flowing the combustion air to the burner at a velocity higher than a flow velocity of the contaminated air and of the auxiliary fuel to induct the contaminated oxygen deficient air and auxiliary fuel into the combustion zone.

13. The method of claim 12 comprising also cooling the burner jet with incoming contaminated air, creating an area of lower combustion temperature in the backmixing zone apart from an area of relatively higher burner jet temperature near the burner.

14. The method of claim 13 comprising also propelling the contaminated air into the area of lower combustion temperature by action of the burner jet.

15. The method of claim 13 comprising also maintaining the lower combustion temperature at no more than 60% of the relatively high burner jet temperature near the burner.

16. The method of claim 1 wherein at least 99% of volatile organic material in the contaminated air is destroyed.

17. The method of claim 16 wherein at least 99.9% of the volatile organic material is destroyed.

18. The method of claim 1, wherein a stream of containing nitrogen with volatile gases is also introduced into the combustion chamber.

19. A method for incinerating air contaminated with volatile organic material, the method comprising providing contaminated air containing from 5 to 18 volume percent oxygen and organic volatile compounds, said air being incapable of providing stable combustion;

introducing the said air into a combustion chamber having a burner connected thereto from which a burner jet projects into the combustion chamber, the combustion chamber having a backmixing zone therein, introducing fuel gas and combustion air to the burner, the combustion air containing an oxygen level that is about stoichiometric for complete combustion of the fuel gas, the fuel gas and air being introduced in quantities sufficient to sustain the burner jet, introducing auxiliary fuel into the combustion chamber, burning the said air, combustion air, fuel gas and auxiliary fuel in the combustion chamber to destroy volatile organic material, oxygen for destroying volatile organic material being provided by oxygen present in said air without adding combustion air other than that needed to sustain the burner jet, controlling flow of auxiliary fuel into the combustion chamber to control temperature in the combustion chamber, removing from the combustion chamber products of the burning of said air contaminated with volatile organic material therein, cooling the burner jet with incoming air contaminated with volatile organic material, creating an area of lower combustion temperature in the backmixing zone apart from an area of higher burner jet temperature near the burner, maintaining the lower combustion temperature at no more than 60% of the higher burner jet temperature near the burner, the method resulting in destruction of at least 99% of the volatile organic materials, and venting a flue gas from the combustion chamber, the flue gas containing the products of burning therein, the flue gas having an oxygen content of no more than 7% by volume and no more than 150 parts per million nitrous oxides.

20. The method of claim 19, wherein a stream of containing nitrogen with volatile gases is also introduced into the combustion chamber.

21. The method of claim 18, wherein the volatile gases are selected from the group consisting of hydrogen sulfide, carbon tetrachloride, ethylene dichloride or benzene.

22. The method of claim 20, wherein the volatile gases are selected from the group consisting of hydrogen sulfide, carbon tetrachloride, ethylene dichloride or benzene.

23. The method of claim 1, wherein the volatile organic material is selected from the group consisting of methane, benzene, ethane, hydrogen sulfide, or a mercaptan.

24. The method of claim 19, wherein the volatile organic material is selected from the group consisting of methane, benzene, ethane, hydrogen sulfide, or a mercaptan.

* * * * *